US006042118A

United States Patent [19]

Poitra

[11] Patent Number: 6,042,118

[45] Date of Patent: Mar. 28, 2000

[54] METHOD OF PLAYING A POKER-TYPE GAME

[76] Inventor: Philip Poitra, P.O. Box 376, Belcourt, N. Dak. 58316

[21] Appl. No.: 09/088,861

[22] Filed: Jun. 2, 1998

[51] Int. Cl.[7] ..... A63F 1/00

[52] U.S. Cl. ..... 273/292; 273/306

[58] Field of Search ..... 273/292, 274, 273/309, 306; 463/13

[56] References Cited

U.S. PATENT DOCUMENTS

| | | | |
|---|---|---|---|
| 5,657,993 | 8/1997 | Merlino et al. | 273/292 |
| 5,845,907 | 12/1998 | Wells | 273/292 |

OTHER PUBLICATIONS

Texas Hold–Em by Victor H. Royer, Jul. 1996.

"Draw Poker–Joker Wild", Scarne's Encyclopedia of Games, John Scarne, Harper & Row Publishers, pp. 18, 19, 1973.

*Primary Examiner*—Benjamin H. Layno

*Attorney, Agent, or Firm*—Michael S. Neustel

[57] ABSTRACT

A method of playing a poker-type game wherein the game provides the players an opportunity to increase the amount wagered based upon two of three community cards shown. After each player places a bet, two cards are dealt face down to each player and three cards are dealt face down to the dealer that are "community cards". The dealer then turns over two of the three community cards so that they are facing up. Each player has the opportunity to "double-down". The dealer then turns over the remaining community card and then turns over each player's two cards. The bets are resolved by using the three community cards in combination with each player's two cards based upon a predetermined plurality of winning card combinations similar to poker. The card deck is a standard 52 card deck with one joker to make a 53 card deck. The joker is utilized only in certain combinations as a 'wild card.'

12 Claims, 2 Drawing Sheets

METHOD OF PLAYING A POKER-TYPE GAME

BACKGROUND OF THE INVENTION

1. Field of the Invention

The present invention relates generally to playing card wagering games and more specifically it relates to a method of playing a poker-type game wherein the game provides the players an opportunity to increase the amount wagered based upon two of three community cards shown.

2. Description of the Prior Art

Poker-type card games have been around for years. Typically, these games provide each player the necessary cards for a winning hand. However, no game has disclosed utilizing three community cards in combination with each of the players' two cards received.

Examples of poker-type card games include U.S. Patent No. 5,167,413 to Stanley; U.S. Pat. No. 5,411,257 to Stanley; and U.S. Patent No. 5,288,081 to Breeding which are all illustrative of such prior art.

Stanley (U.S. Pat. Nos. 5,167,413 and 5,411,257) discloses a method of playing a poker-type game and apparatus therefor. Stanley teaches providing each player five cards of which a certain number are face up with at least one face down. The players are each allowed to place additional bets (double-down) based upon the face up cards and what they 'guess' the face down card(s) will be. However, Stanley does not disclose a method of playing a poker-type game wherein three community cards are utilized with two of the community cards face up and two cards dealt face down to each player.

Breeding (U.S. Pat. No. 5,288,081) discloses a method of playing a wagering game that involves each player placing a three-part bet. Two cards are dealt to the dealer face down and three cards to each player face down. Based upon only the disclosure of the three cards each player has, the player determines whether to retain the three-part bet or withdraw one part of the three-part bet. The dealer then turns one of the two community cards face up, and each player then determines whether to withdraw one part of their remaining bet based upon the new face up community card. However, Breeding does not disclose a method of playing a poker-type game wherein three community cards are utilized with two of the community cards dealt face up and two cards dealt face down to each player.

In these respects, the method of playing a poker-type game according to the present invention substantially departs from the conventional concepts of the prior art, and in so doing provides a method of playing a poker-type game wherein the game provides the players an opportunity to increase the amount wagered based upon two of three community cards shown.

SUMMARY OF THE INVENTION

It is an object to provide a method of playing a poker-type game that is exciting and interesting to play.

An additional object is to provide a method of playing a poker-type game that is easy to learn, largely being based upon five-card poker.

A further object is to provide a method of playing a poker-type game that allows players to increase the amount wagered based upon two of three community cards shown.

Another object is to provide a method of playing a poker-type game that is easy to learn, yet demands skill of players in making strategic decisions about whether to double-down or not.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
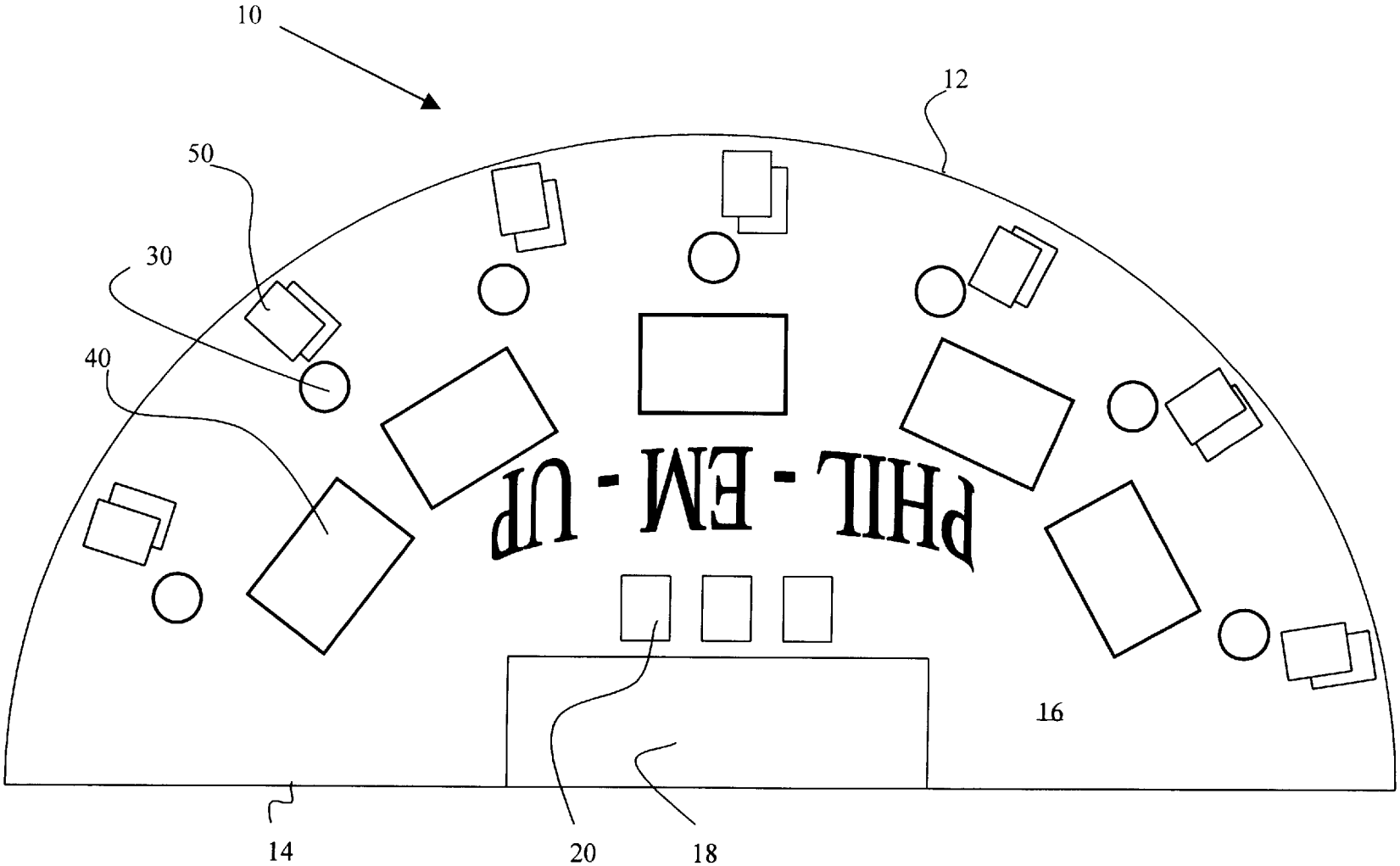
FIG. 1 depicts the table layout used in playing the wagering game of the present invention.
Figure 2:
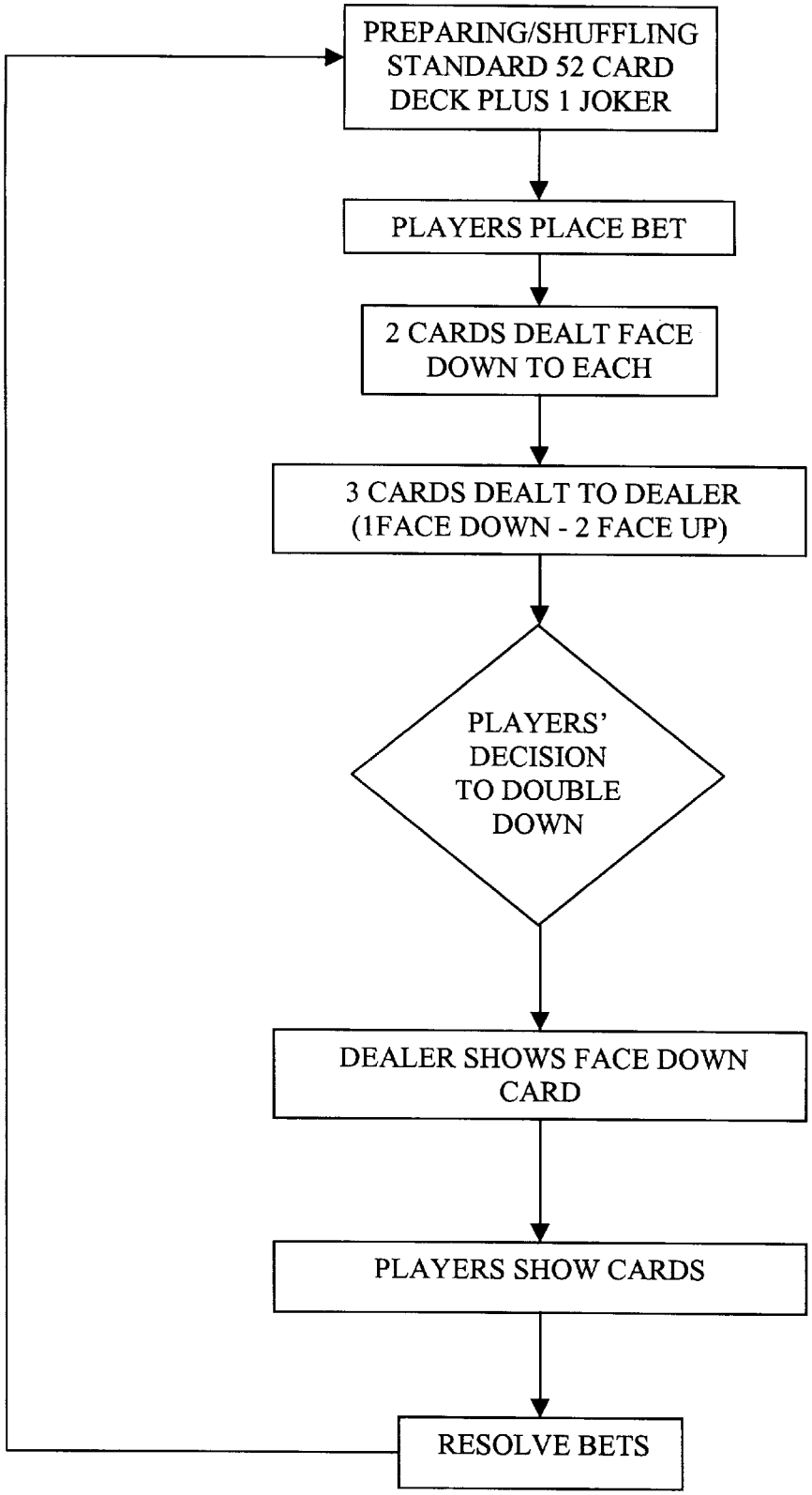
FIG. 2 is a block diagram representing the flow of play in the game.

Turning now descriptively to the drawings, in which similar reference characters denote similar elements throughout the several view, FIGS. 1 through 2 illustrate a method of playing a poker-type game. Referring specifically to FIG. 1, the present invention utilizes a typical casino game table 10. The table has a curved side 12 for accommodating up to seven players and a straight side 14 for accommodating a dealer. The game table 10 has a flat surface 16 covered with felt or other appropriate material. Although seven playing positions for individual players are provided, it is not essential to the game that exactly seven individuals play and as many players who can fit around the game may participate.

A chip tray 18 is positioned in front of the dealer. An area in front of the chip tray 18 receives the community cards 18. Each of the playing positions includes a betting area 30 and an area to position the player cards 50. There is preferably at least one payout schedule 40 that discloses to the players the winning card combinations and the appropriate payouts.

Referring to the flow diagram of FIG. 2, the initial step in playing the game of the present invention is preparing or shuffling a deck of cards by a shuffling machine or by hand-shuffling to provide a shuffled deck. The deck of cards is preferably a standard 52-card deck with one joker to make 53 cards. The joker is utilized as a "wild card" only in specified winning combinations such as five aces, flushes and straights. Those skilled in the art will appreciate that various combinations of decks may be utilized for the present invention.

After each player places an initial bet in the betting area 30, two player cards 50 are dealt face down to each player and three "community cards" 20 are dealt face down to the dealer. Each player may examine their own player cards 50, but not any of the other player cards 50 of other players. The dealer then turns over two of the three community cards 20 so that they are facing up. The dealer then asks each player whether they want to "double-down" based upon their initial bet. Each player makes the decision on the basis of their own player cards 50 and the two face up community cards 20.

After each player has been questioned and has decided whether to double-down, the dealer then turns over the remaining face down community card 20. Now, each player has a five-card hand comprised of the two player cards 50 each player was originally dealt plus the three revealed community cards 20.

The dealer shows each individual player's player cards 50 and resolves each player's bet based upon the five-card hand and determines the payout, if any, based upon the payout schedule 40 at the particular game table 10 or casino. The dealer or house collects bets on non-winning hands. The hand is then over and the flow of the game returns to preparing and shuffling the deck for a new hand.

A typical pay schedule 40 would be as follows:

| | |
|---|---|
| Four Aces with Joker | 1000-1 |
| Royal Flush | 500-1 |
| Royal Flush with Joker | 250-1 |
| Straight Flush | 200-1 |
| Straight Flush with Joker | 100-1 |
| Four of a Kind | 50-1 |
| Four of a Kind with Joker | 25-1 |
| Full House | 11-1 |
| Full House with Joker | 9-1 |
| Flush | 8-1 |
| Flush with Joker | 7-1 |
| Straight | 5-1 |
| Straight with Joker | 4-1 |
| Three of a Kind | 3-1 |
| Two Pairs | 2-1 |
| Pair of 10's, Queens, Kings or Aces | 1-1 (even money) |

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a poker-type game comprising:

a) providing a deck of cards;

b) shuffling said deck of cards;

c) placing an initial bet by each player;

d) dealing only two player cards face down to each player;

e) dealing only three community cards, wherein one of said three community cards is face down with the other two face up;

f) giving each player a chance to view only the two player cards and only the two face up community cards, then giving the player the opportunity to double said initial bet;

g) showing all of said community cards, thereby providing a hand for each player comprising said three community cards and said two player cards; and resolving each player's bet based upon a predetermined payout schedule.

2. The method of playing a poker-type game of claim 1, wherein said wherein said deck of cards comprises a standard 52 card deck with a joker for a total of 53 cards.

3. The method of playing a poker-type game of claim 2, wherein said predetermined payout schedule includes basic poker hand combinations.

4. The method of playing a poker-type game of claim 3, wherein said predetermined payout schedule includes only specified combinations that may utilize said joker.

5. A method of playing a poker-type game comprising:

a) providing a deck of cards;

b) shuffling said deck of cards;

c) placing an initial bet by each player;

d) dealing only two player cards face down to each player;

e) dealing only three community cards face down;

f) showing only two of said three community cards;

g) giving each player a chance to view only the two player cards and only the two face up community cards, then giving the player the opportunity to double said initial bet;

h) showing all of said community cards, thereby providing a hand for each player comprising said three community cards and said two player cards; and resolving each player's bet based upon a predetermined payout schedule.

6. The method of playing a poker-type game of claim 5, wherein said wherein said deck of cards comprises a standard 52 card deck with a joker for a total of 53 cards.

7. The method of playing a poker-type game of claim 6, wherein said predetermined payout schedule includes basic poker hand combinations.

8. The method of playing a poker-type game of claim 7, wherein said predetermined payout schedule includes only specified combinations that may utilize said joker.

9. A method of playing a poker-type game comprising:

(a) placing an initial bet by at least one player;

(b) dealing only two player cards face down to said at least one player;

(c) dealing only three community cards to a community section, wherein one of said three community cards is face down with the other two face up;

(d) after step (c), giving said at least one player an opportunity to view only the two player cards and only the two face up community cards, then giving the player the opportunity to double said initial bet;

(e) after step (d), showing all of said community cards, thereby providing a hand for said at least one player comprising said three community cards and said two player cards; and (f) resolving said at least one player's bet based upon a predetermined payout schedule.

10. The method of playing a poker-type game of claim 9, wherein said wherein said deck of cards comprises a standard 52 card deck with a joker for a total of 53 cards.

11. The method of playing a poker-type game of claim 10, wherein said predetermined payout schedule includes basic poker hand combinations.

12. The method of playing a poker-type game of claim 11, wherein said predetermined payout schedule includes only specified combinations that may utilize said joker.

* * * * *